US009975212B1

(12) United States Patent
Gleason et al.

(10) Patent No.: US 9,975,212 B1
(45) Date of Patent: May 22, 2018

(54) GRINDING SYSTEM WITH SPOOL APPARATUS FOR SUPPLYING WIRE FROM A SPOOL DURING GRINDING

(71) Applicant: GLEBAR ACQUISITION, LLC, Franklin Lakes, NJ (US)

(72) Inventors: Robert C. Gleason, Franklin Lakes, NJ (US); John Bannayan, Franklin Lakes, NJ (US)

(73) Assignee: GLEBAR ACQUISITION, LLC, Franklin Lakes, NJ (US)

( * ) Notice: Subject to any disclaimer, the term of this patent is extended or adjusted under 35 U.S.C. 154(b) by 76 days.

(21) Appl. No.: 14/676,236

(22) Filed: Apr. 1, 2015

Related U.S. Application Data

(60) Provisional application No. 61/975,461, filed on Apr. 4, 2014.

(51) Int. Cl.

| | |
|---|---|
| ***B24B 41/00*** | (2006.01) |
| ***B24B 5/38*** | (2006.01) |
| ***B24B 49/03*** | (2006.01) |
| ***B24B 49/12*** | (2006.01) |

(52) U.S. Cl.
CPC ..... *B24B 5/38* (2013.01); *B24B 41/005* (2013.01); *B24B 49/03* (2013.01); *B24B 49/12* (2013.01)

(58) Field of Classification Search
CPC ..... B24B 5/38; B24B 41/005; B24B 49/03; B24B 49/12; D07B 2207/4004; D07B 2207/4013; D07B 2207/4031
See application file for complete search history.

(56) References Cited

U.S. PATENT DOCUMENTS

| | | | | |
|---|---|---|---|---|
| 2,497,407 A * | 2/1950 | Green | B24B 5/38 | 19/0.64 |
| 2,891,376 A * | 6/1959 | Stoddard | D02G 1/0266 | 57/286 |
| 3,154,891 A * | 11/1964 | Weisgerber | B24B 5/355 | 451/244 |
| 3,348,368 A * | 10/1967 | Dudzik | D02G 1/0286 | 57/286 |
| 3,926,072 A * | 12/1975 | Richardson | D07B 3/085 | 475/6 |

(Continued)

*Primary Examiner* — Christopher M Koehler
*Assistant Examiner* — Joel Crandall
(74) *Attorney, Agent, or Firm* — Fitzpatrick, Cella, Harper & Scinto

(57) ABSTRACT

A spool-fed grinding system includes a spooling system, a grinding machine, and a computer controller. The spooling mechanism includes a spool assembly from which wire is unwound, with the spool assembly having an axis of rotation on which a spool spins to unwind the wire. The grinding machine includes a grinding wheel, a linear movement mechanism, and a rotation mechanism. The linear movement mechanism holds and linearly moves the wire along a longitudinal axis during grinding, and the rotation mechanism rotates the wire about the longitudinal axis during grinding. The axis of rotation of the spool and the longitudinal axis generally are not transverse with each other. The computer controller is programmed to control coordinated operation of the spooling mechanisms and the grinding machine, such that the spooling mechanism is controlled to rotate the spool at a same rotation speed as a rotation speed of the wire during grinding.

73 Claims, 8 Drawing Sheets

(56) References Cited

U.S. PATENT DOCUMENTS

| | | | | | |
|---|---|---|---|---|---|
| 4,015,415 | A | * | 4/1977 | Otsuki | D07B 3/045 57/13 |
| 5,480,342 | A | | 1/1996 | Bannayan et al. | 451/15 |
| 5,567,195 | A | * | 10/1996 | Tufts | B23Q 1/76 451/11 |
| 5,774,973 | A | * | 7/1998 | Aoyama | B21B 1/466 228/13 |
| 5,791,134 | A | * | 8/1998 | Schneider | B65H 57/20 57/11 |
| 6,852,006 | B1 | | 2/2005 | Gleason et al. | 451/11 |
| 7,429,208 | B1 | | 9/2008 | Gleason et al. | 451/11 |
| 7,585,206 | B2 | | 9/2009 | Memmelaar, Sr. et al. | 451/10 |

* cited by examiner

GRINDING SYSTEM WITH SPOOL APPARATUS FOR SUPPLYING WIRE FROM A SPOOL DURING GRINDING

CROSS REFERENCE TO RELATED APPLICATION

The present application claims the benefit of U.S. Provisional Application No. 61/975,461 filed on Apr. 4, 2014, the entire contents of which is incorporated herein by reference.

FIELD OF THE INVENTION

The present invention relates to generally to a grinding system with an apparatus that enables grinding of wire fed from a spool to a grinding machine. More specifically, the present invention relates to a grinding system with an automated apparatus that feeds wire from a spool to a grinding system while the wire is spinning during grinding.

RELATED ART

Centerless outside-diameter or "OD" grinders are commonly used to remove material from an outer surface of a piece of wire, to produce a ground article having a circular radial cross section and a longitudinal cross section that can take on various profiles, e.g., tapered, saw-toothed, etc.

A notable drawback of conventional centerless OD grinders is the difficulty in producing ground articles having precise dimensions in a reproducible manner. That is, the ability to mass produce ground articles having tight tolerances, and the ability to predictably produce such articles at will, have been a challenge.

One solution that has been proposed is described in U.S. Pat. No. 5,480,342. This solution utilizes a series of photoelectric sensors to detect the movement of the trailing edge of a piece of wire or feedstock as it is being ground. Each sensor is positioned along a line parallel to the line of travel of the feedstock, and the sensors are spaced apart at known distances. As the trailing edge goes past a sensor, that sensor produces a signal that is sent to a microprocessor, which calculates the feed rate based on the known distance between each sensor and the times at which the trailing edge passes each sensor. The feed rate is used to control the position of a regulating wheel of the centerless OD grinder to thereby control the diameter of the feedstock along its length during grinding.

The solution described in U.S. Pat. No. 5,480,342, however, requires the use of a finite length of feedstock, because, the length and/or diameter of the ground product only can be accurately controlled where the trailing edge of the feedstock falls within the sensing range of the sensors. Therefore, in order to precisely grind a piece of feedstock of arbitrarily long length to have a desired profile along its entire length, an sufficiently long sensor system or linear array of sensors is required. Such an arrangement requires not only a large manufacturing area to house the grinder and its associated long sensor array, but also entails the costs of deploying the additional sensing capabilities.

Another solution is described in U.S. Pat. No. 7,429,208, which discloses a mechanism for controlling the movement of feedstock during grinding by using collet assemblies. Collets of the collet assemblies selectively grip and release the feedstock under the control of a computer processor. The collets of the collet assemblies are linearly transported by a motor assembly, such that the feedstock can be continuously and controllably pulled in a linear or longitudinal manner during grinding, backwards and forwards, without the need for monitoring the endpoint of the feedstock. Moreover, through use of the collet assemblies, the feedstock can be held and rotated about a longitudinal grinding axis of the feedstock during grinding, with the longitudinal or linear movement of the feedstock as well as the rotation speed of the feedstock being controlled by the computer processor to repeatably produce ground articles having the same dimensions. An example of a grinding system that utilizes such collet assemblies is the CAM.2 Micro Grinding System (Glebar Company, Inc., Franklin Lakes, N.J.).

With the computer-controlled collet assemblies and motor assembly taught in U.S. Pat. No. 7,429,208, it is possible to continuously supply feedstock to a grinding system to be ground. One difficulty that can arise with continuous grinding occurs when a very long length of feedstock is to be ground. In such a case, end portions of the feedstock, i.e., portions that are not positioned between the collets and in a region to be ground by the grinder, can pose safety concerns as well as concerns regarding how these portions can cause instability in the grinding process. More specifically, these end portions must rotate at the same rotation speed as the portion of the feedstock positioned between the collets. If the end portions are very long, however, the high-speed rotation of the feedstock during grinding causes the long end portions to whip around in an uncontrolled and possibly dangerous manner.

A grinding system is described in U.S. Pat. No. 7,585,206 in which feedstock is held on two spools oriented parallel to each other. That is, the first spool has a first axis about which the first spool unwinds feedstock to be ground, and the second spool has a second axis about which the second spool winds feedstock after grinding. The first axis is oriented parallel to the second axis, and both the first and second axes are oriented transverse to a third axis, which is the rotation axis of the feedstock. As the feedstock rotates about the rotation axis during grinding, the first and second spools rotate about the third axis during grinding.

One concern with the arrangement disclosed in U.S. Pat. No. 7,585,206 is the spool dynamics involved when the spools have their rotation axes, i.e., the first and second axes, oriented transverse to the rotation axis of the feedstock, i.e., the third axis. The excessive vibrations that can occur with this arrangement can cause instabilities that can preclude the use of high rotation speeds for rotating the feedstock and the spools, due to the potential for instability with such an arrangement. This constraint or limit imposed on the rotation speed reduces the quality level of the surface finish and dimensional accuracy (i.e., the accuracy of the profile as well as the circumference) that can be achieved for the ground article.

BRIEF DESCRIPTION OF THE INVENTION

Aspects of the present invention provide a grinding system with a spool apparatus that can supply feedstock or wire to a grinding machine during grinding, in which the spool apparatus minimizes or avoids the vibrational instability of conventional arrangements.

In a first aspect of the invention, a spool-fed grinding system includes a spooling mechanism, a grinding machine, and a computer controller programmed to control coordinated operation of the spooling mechanism and the grinding machine. The spooling mechanism includes a spool assembly from which feedstock or wire is unwound from a spool mounted thereon. The spool assembly has an axis of rotation on which the spool spins to unwind the wire. The grinding machine includes a grinding wheel, a linear movement mechanism, and a rotation mechanism. The grinding wheel is arranged to grind a profile along an outer surface of the wire. The linear movement mechanism is structured to pull wire from the spool, causing the wire to unwind from the spool, and to hold and controllably cause continuous or stop-and-start longitudinal or linear movement of the wire along a longitudinal grinding axis during grinding. The rotation mechanism rotates the wire about the longitudinal grinding axis during grinding.

In the spool-fed grinding system, the axis of rotation of the spool and the longitudinal grinding axis generally are not transverse with each other.

In a second aspect of the invention, a dual-spool wire grinding system is provided for grinding wire. The dual-spool system includes first and second spooling mechanisms, a grinding machine, and a computer controller that controls the first and second spooling mechanisms and the grinding machine. The first spooling mechanism includes a first spool assembly from which wire is unwound from a first spool mounted thereon. The first spool assembly has a first axis of rotation on which the first spool spins to unwind the wire before grinding. The second spooling mechanism includes a second spool assembly to which the wire is wound after grinding. The second spool assembly has a second axis of rotation on which a second spool spins to wind the wire after grinding. The grinding machine, which is positioned between the first spooling mechanism and the second spooling mechanism, includes a grinding wheel, a linear movement mechanism, and a rotation mechanism. The linear movement mechanism holds and linearly moves the wire during grinding by the grinding wheel. In particular, the linear movement mechanism is structured to pull wire to be ground from the first spool, causing the wire to unwind from the first spool, and to controllably cause continuous or stop-and-start longitudinal movement of the wire along a longitudinal grinding axis during grinding, between the first spooling mechanism and the second spooling mechanism. The rotation mechanism rotates the wire about the longitudinal grinding axis during grinding. The computer controller controls the first and second spooling mechanisms to rotate the first and second spools at approximately the same rotation speed as a rotation speed of the wire during grinding.

In the dual-spool system, the first axis of rotation of the first spool, the second axis of rotation of the second spool, and the longitudinal grinding axis generally are not transverse with each other.

BRIEF DESCRIPTION OF THE DRAWINGS

The present invention will be more readily understood from a detailed description of embodiments of the invention considered in conjunction with the attached drawings, of which.

DETAILED DESCRIPTION OF EMBODIMENTS OF THE INVENTION

Single-Spool Grinding System

Figure 1A:
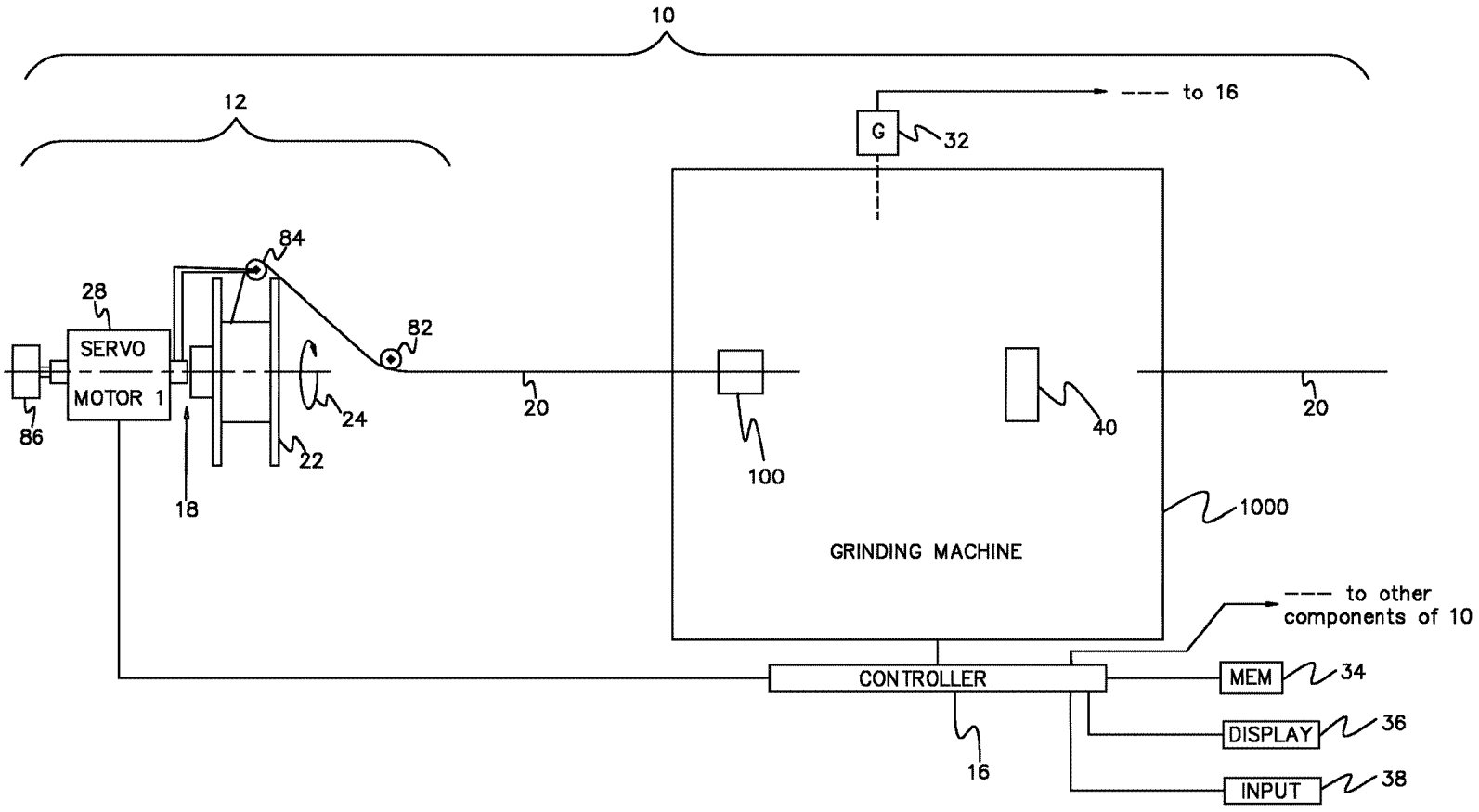
FIG. 1A schematically shows a spool-fed grinding system according to an embodiment of the invention.
Figure 1B:
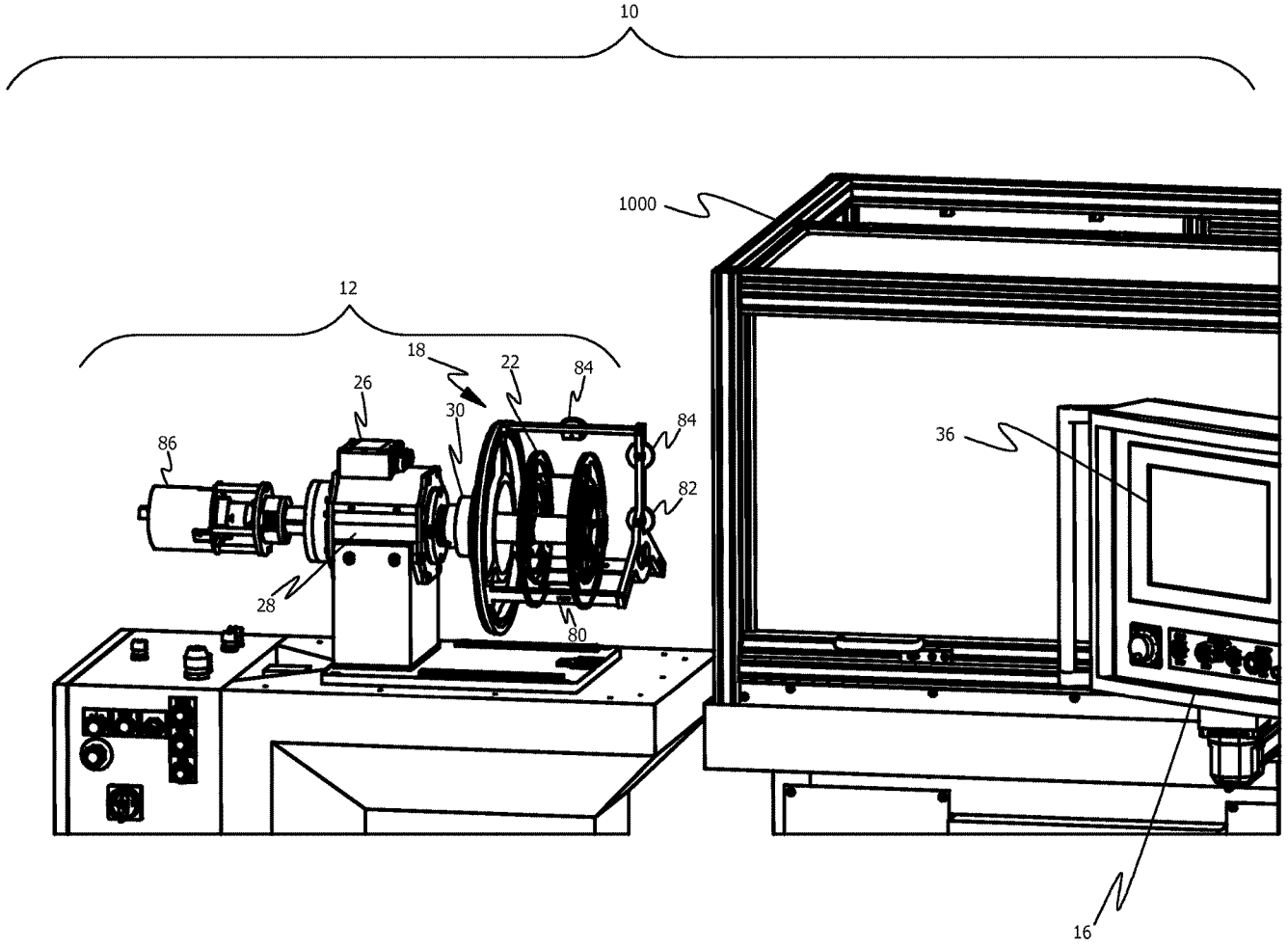
FIG. 1B schematically shows a supply-side spooling mechanism according to an embodiment of the present invention, for supplying wire to be ground.

FIGS. 1A and 1B schematically show a spool-fed grinding system 10. The system 10 includes a spooling mechanism 12, a grinding machine 1000, and a computer controller 16 programmed to control coordinated operation of the spooling mechanism 12 and the grinding machine 1000. The spooling mechanism 12 includes a spool assembly 18 from which feedstock or wire 20 is unwound from a spool 22 mounted thereon. The spool assembly 18 has an axis of rotation 24 on which the spool 22 spins to unwind the wire 20.

Figure 2A:
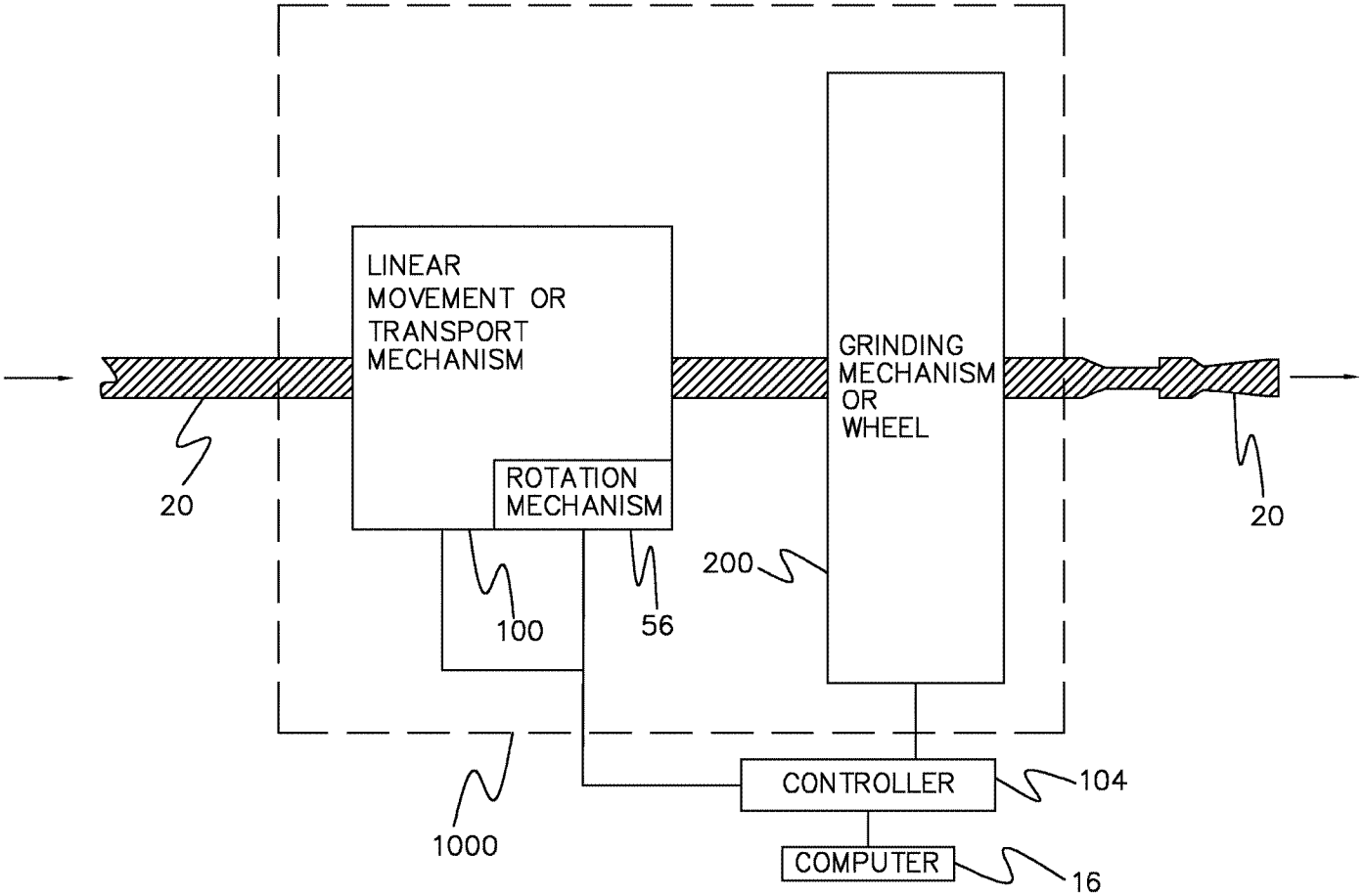
FIG. 2A schematically shows a grinding machine according to an embodiment of the invention.
Figure 2B:
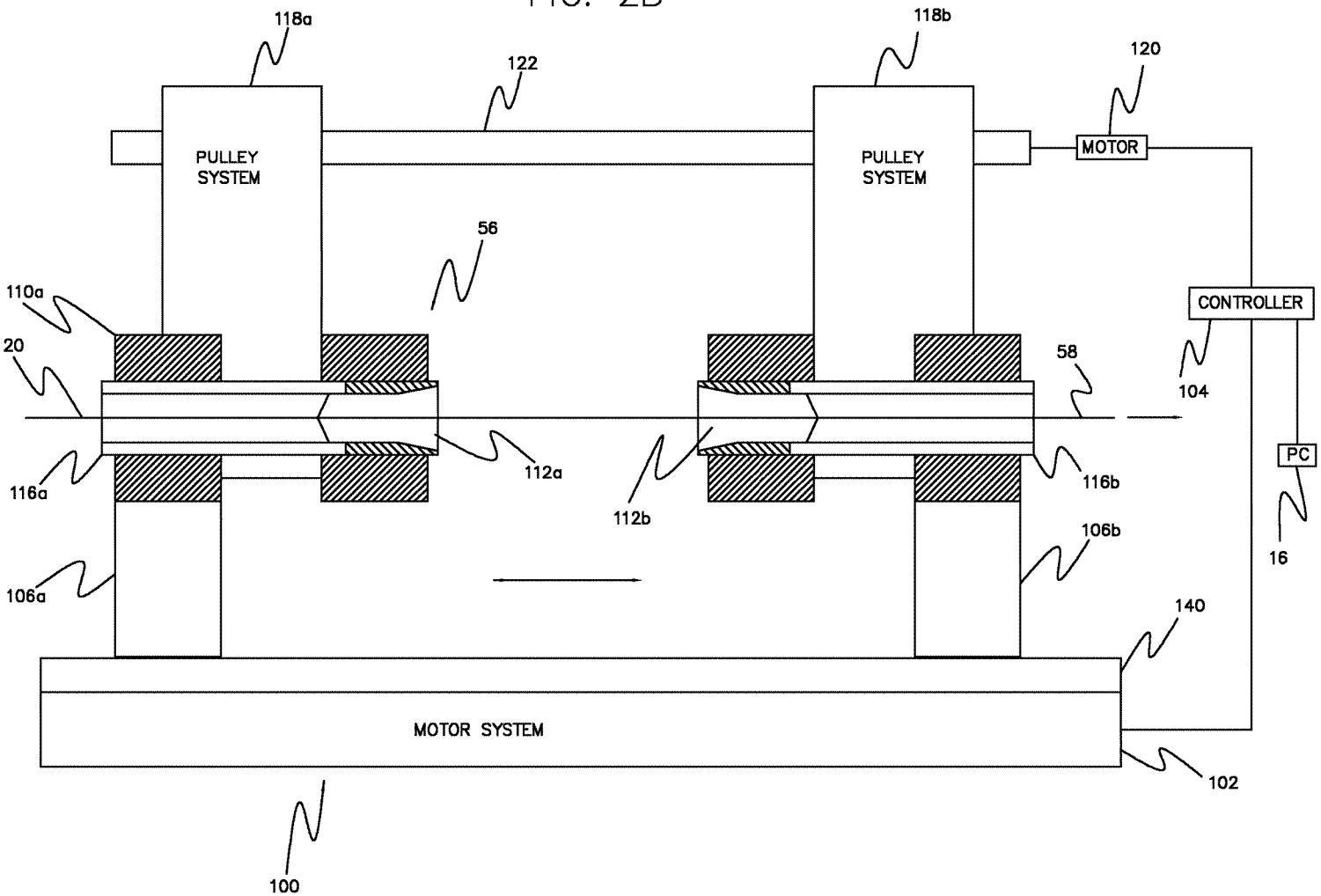
FIG. 2B schematically shows a linear movement mechanism and a rotation mechanism according to an embodiment of the invention.
Figure 2C:
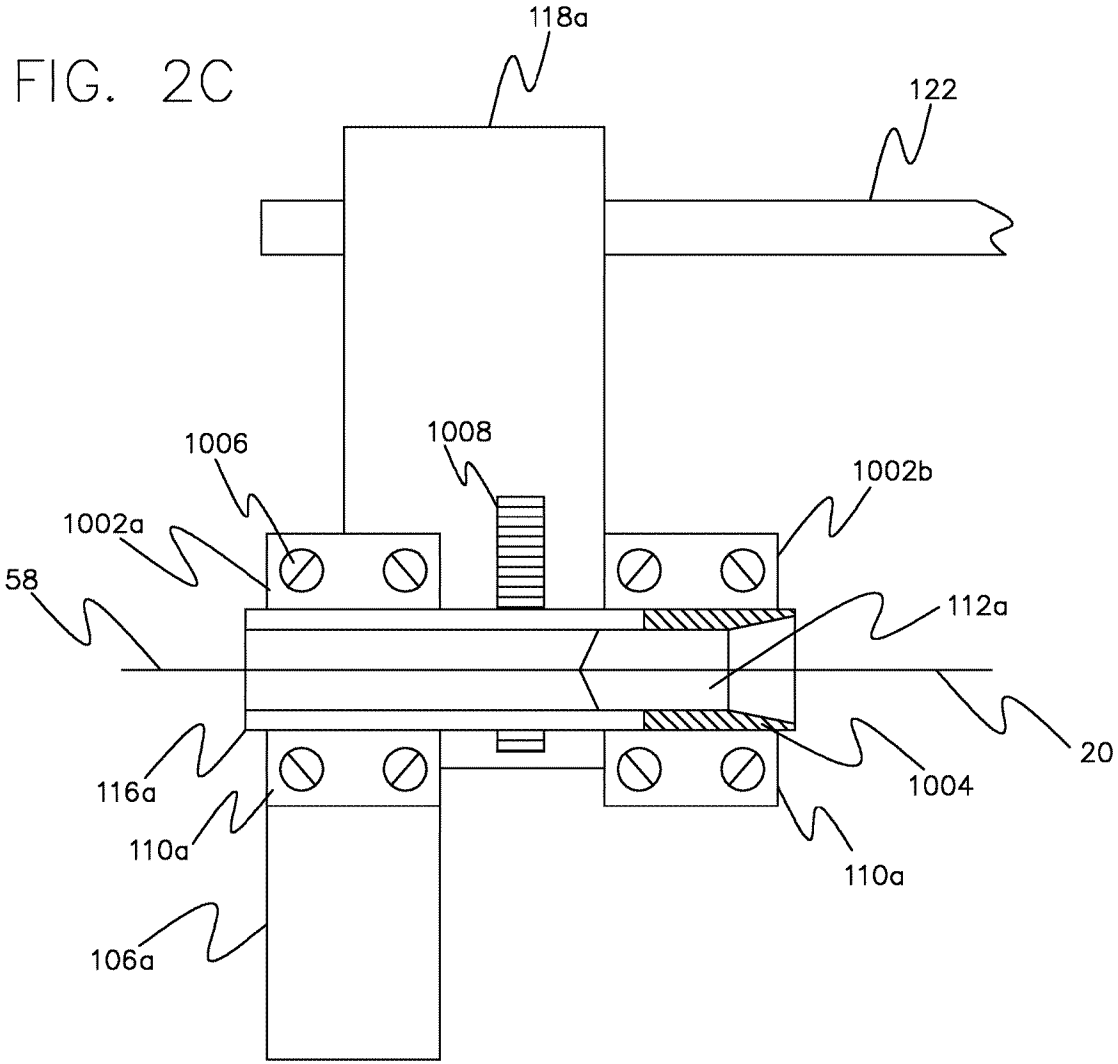
FIG. 2C schematically shows a portion of a collet assembly according to an embodiment of the invention.

The grinding machine 1000, details of which are schematically shown in FIGS. 2A, 2B, and 2C include a grinding mechanism or wheel 200, a transport or linear movement mechanism 100, and a rotation mechanism 56 attached to the linear movement mechanism 100. The grinding wheel 200 is arranged to grind a profile along an outer surface of the wire 20. The linear movement mechanism 100 is structured to hold and linearly move the wire 20 along a longitudinal grinding axis 58 during grinding. The rotation mechanism 56 rotates the wire about the longitudinal grinding axis 58 during grinding.

In an embodiment, the grinding machine 1000 is the CAM.2 Micro Grinding System (Glebar Company, Inc., Franklin Lakes, N.J.). Additional details regarding the grinding machine 1000 may be found below and in U.S. Pat. No. 7,429,208, which is incorporated by reference herein.

The spooling mechanism 12 is controlled by the computer controller 16 to rotate the spool 22 at a rotation speed that is approximately the same as a rotation speed of the wire 20 during grinding, such that there is no twisting of the wire 20 during grinding while the wire 20 is attached to the spool 22. The axis of rotation 24 of the spool 22 and the longitudinal grinding axis 58 generally are not transverse with each other.

In an embodiment, the axis of rotation 24 of the spool 22 and the longitudinal grinding axis 58 generally are oriented to coincide with each other as a common axis.

In another embodiment, the axis of rotation 24 of the spool 22 and the longitudinal grinding axis 58 are oriented to be approximately parallel axes.

The spool 22 is not electrically powered to unwind the wire 20. Unwinding of the wire 20 from the spool 22 occurs when the linear movement mechanism 100, which holds the wire 20 during grinding, pulls the wire 20 from the spool 22.

The spool assembly 18 includes a brake mechanism 86 for maintaining tension on the wire 20 during grinding and unwinding. The brake mechanism may be a magnet, a mechanical clutch, a friction clutch, a servo motor, or any other device that imparts rotational resistance to free spinning of the spool 22.

As shown in FIGS. 1A and 1B, the spooling mechanism 12 includes a frame assembly 80 for supporting a guide device 82 that orients the wire 20 unwound from the spool 22, such that a portion of the wire 20 between the guide device 82 and the linear movement mechanism 100 has a predetermined general position relative to the longitudinal grinding axis 58. For example, the guide device 82 may be a pulley that is positioned to align the wire 20 unwound from the spool 22 to a predetermined position relative to the linear movement mechanism 100. The predetermined position may be a position that aligns the portion of the wire 20 between the pulley (i.e., guide device) 82 and the linear movement mechanism 100 to:

- an angle within 35° of the longitudinal grinding axis 58, or
- an angle within 25° of the longitudinal grinding axis 58, or
- an angle within 15° of the longitudinal grinding axis 58, or
- an angle within 10° of the longitudinal grinding axis 58, or
- approximately coincide with the longitudinal grinding axis 58.

The pulley (i.e., guide device) 82 may be one of a plurality of pulleys 84 arranged to guide the wire 20, which is unwound from the spool 22, toward the linear movement mechanism 100 of the grinding machine 1000.

Alternatively, the guide device 82 need not include any pulley but instead may be support member (not shown) that is arranged to align the wire 20 unwound from the spool 22 to a predetermined height. For example, the predetermined height may be approximately the same height as that of the longitudinal grinding axis 58. The support member can be a horizontal or flat bar, a V-shaped bar, a U-shaped bar, or the like.

In an embodiment, the spooling mechanism 12 includes a bearing or belt assembly 26 coupled to the spool assembly 18, and a motor 28 coupled to the bearing or belt assembly 26. In FIG. 1B the bearing or belt assembly 26 and the motor 28 are shown to be housed together in their coupled state. In another embodiment, the motor 28 is directly coupled to the spool assembly 18 (see FIG. 1A). The motor 28 is controlled by the computer controller 16 to rotate the spool assembly 18 at approximately the same rotation speed as the rotation speed of the wire 20 during grinding.

In an embodiment, the bearing or belt assembly 26 is coupled to a shaft assembly 30 having a distal end that is structured to have the spool 22 mounted thereon during grinding. In another embodiment, the shaft assembly 30 is directly coupled to the motor 28. The shaft assembly 30 is rotated by the motor 28 during grinding, such that the axis of rotation 24 of the spool 22 is approximately parallel to or that coincides with the longitudinal grinding axis 58. The rotation speed of the spool 22 is approximately the same as the rotation speed of the wire 20 during grinding. The shaft assembly 30 may include a single shaft or a plurality of coordinated shafts.

In an embodiment, the frame assembly 80 is coupled to the shaft assembly 30, such that the frame assembly 80 rotates at approximately the same rotation speed as the rotation speed of the wire 20 during grinding.

The linear movement mechanism 100 includes a collet assembly 110*a* that is controlled by the computer controller 16 to grip the wire 20 during grinding. Optionally, the linear movement mechanism 100 includes a pair of collet assemblies 110*a* and 110*b*, which are controlled by the computer controller 16, and which selectively grip and release the wire in a coordinated manner to move the wire 20 continuously during grinding. When only one collet assembly 110*a* or 110*b* is used, the wire 20 can be moved in a discontinuous or stop-and-start manner during grinding. When the pair of collet assemblies 110*a* and 110*b* are used, the wire 20 can be moved continuously.

The computer controller 16 controls the grinding machine 1000, and thus controls the linear movement mechanism 100 and the grinding mechanism or wheel 200, as shown in FIG. 2B. That is, the computer controller 16 controls the linear movement mechanism to precisely control the feed rate and longitudinal position of an arbitrarily long length of the wire 20, and also controls a grinding position of the grinding mechanism or wheel 200 to precisely grind the feedstock 20 to a desired diameter. A multi-axis controller 104 controls the linear movement mechanism 100 and provides position control to the grinding mechanism 200.

The linear movement mechanism 100 includes a linear servo motor system 102, for example, a Parker™ 802-2849 motor system (Parker Hannifin Corp., Rohnert Park, Calif.) with a 0.1 μm linear scale, controlled by the controller 104. The controller 104 may be, for example, a Parker Compumotor™ 6K6 or 6K8 controller (Parker Hannifin Corp., Rohnert Park, Calif.), or a Power Brick controller (Delta Tau Data Systems, Inc., Chatsworth, Calif.), or a Power UMAC controller (Delta Tau Data Systems, Inc., Chatsworth, Calif.) or any other multi-axis control system that provides coordinated outputs to the linear movement mechanism 100 and the grinding mechanism 200. The motor system 102 drives two carriage assemblies 106*a*, 106*b* to move along a track 140, in directions indicated by the horizontal doubled-headed arrows. It should be understood that, although the use of two carriage assemblies is described herein, more than two carriage assemblies may be used. Optionally, when only discontinuous or stop-and-start motion is needed, a single carriage assembly 106*a* or 106*b* may be used.

The controller 104 is equipped with a microprocessor (not shown) for processing a control program and control-data files stored in an internal memory (not shown) of the controller 104. The control program and the control-data files may be downloaded to a memory 34 via the computer controller 16. The computer controller 16 is connected to the controller 104 directly or via a network (not shown). Optionally, the controller 104 may be incorporated in the computer controller 16 or may be a separate unit controlled by the computer controller 16, which is the main controller that controls the overall operation of the spool-fed grinding system 10.

Each carriage assembly 106*a*, 106*b* supports a respective collet assembly 110*a*, 110*b*. Details of the collet assembly 110*a* are schematically shown in FIGS. 2B and 2C. The collet assembly 110*b* is conceptually the same as the collet assembly 110*a*.

The collet assembly 110*a* is formed of two portions 1002*a*, 1002*b*, each of which are arranged around a drawbar 116*a*. Bearings 1006 are provided on the collet assembly 110*a* to enable the drawbar 116*a* to rotate relative to the collet assembly 110*a*. Between the portions 1002*a*, 1002*b* of the collet assembly 110*a* is a pulley mechanism 118*a* of the rotation system 56, which will be described later. The pulley mechanism 118*a* provides the rotational driving force for rotating the drawbar 116*a* via action of a pulley device 1008. Within the drawbar 116*a* is a collet 112*a* and a sleeve 1004. For example, the collet 112*a* may be a Levin™ collet, which opens and closes by using compressed air to move the sleeve 1004 back and forth over the collet 112*a*. The collet 112*a* is normally in an opened position, with the sleeve 1004 in a retracted position, and is closed when the sleeve 1004 is positioned to surround the collet 112*a*. Compressed air is used to provide the force to move the sleeve 1004 to close the collet 112*a*. A compressed-air valve (not shown), is activated to an opened or closed position by signals from the controller 104. It should be understood that the present invention is not limited to the use of a compressed-air mechanism for opening and closing the collet 112*a*, and the scope of the present invention encompasses other mechanisms, including electromagnetic, ferrofluidic, and hydraulic mechanisms.

The feedstock or wire 20 to be ground by the grinding machine 1000 is fed through an axial opening of drawbar 116*a* and through the collet 112*a*, which alternately grips and releases the feedstock 20 while rotating and moving reciprocally to control the movement of the feedstock 20 and its longitudinal position during grinding. When the collet 112*a* is in an opened position, it can move with respect to the feedstock 20; when in a closed position, the collet 112*a* holds the feedstock 20 and moves together with it.

The drawbar 116*a* is generally tubular in shape, but may also have other shapes as long as an opening or cut-out is provided through which the feedstock 20 is fed. The drawbar 116*a* and the collet 112*a* rotate together and also move in the longitudinal direction (along the axis of the feedstock 20) together.

One portion 1002*b* of the collet assembly 110*a* is slidable relative to the feedstock 20, and is connected to the sleeve 1004. When compressed air is applied, the sleeve 1004 along with the portion 1002*b* of the collet assembly slide along the drawbar 116*a*, such that the sleeve 1004 surrounds the collet 112*a* and the collet 112*a* is closed to grip the feedstock 114. The other portion 1002*a* of the collet assembly 110*a* is attached to the carriage assembly 106 and remains stationary when the collet 112*a* opens and closes. Thus, the drawbar 116 connects the portions 1002*a*, 1002*b* of the collet assembly, with the portion 1002*a* being longitudinally fixed with respect to the drawbar 116*a*. The slidable portion 1002*b* of the collet assembly 110*a*, along with the sleeve 1004, slide along the drawbar 116*a* to open and close the collet 112*a*. By virtue of this arrangement, when the collet 112*a* is opened or closed, the change in pressure of the compressed air causes the slidable portion 1002*b* of the collet assembly 110*a* and the sleeve 1004 to move, without affecting the longitudinal position of the collet 112*a*. In this way, pressure changes that occur during the opening and closing of the collet 112*a* do not cause inadvertent movement of the collet 112*a* along the longitudinal axis of the feedstock 20 and, thus, will not cause a spurious change in the longitudinal position of the feedstock 20 along the track 140 during grinding.

The drawbars 116*a*, 116*b* are connected to the rotation mechanism 56, which causes them as well as the collets 112*a*, 112*b* to synchronously rotate around their central axis, which corresponds to the longitudinal grinding axis 58 shown in FIG. 2B. The rotation mechanism 56 includes friction-drive pulley systems 118*a*, 118*b*, which are connected to each other by a common shaft 122, and a motor 120, as schematically shown in FIG. 2B. The motor 120 rotates the shaft 122, which causes the pulley systems 118*a*, 118*b* to rotate the drawbars 116*a*, 116*b* and the collets 112*a*, 112*b*.

The pulley system 118*b* and the shaft 122 move longitudinally along with the collet assembly 110*b*. The pulley system 118*a* moves longitudinally along with the collet assembly 110*b*, and includes slidable bearings, such as those available from Thompson Industries, Inc. (Radford, Va.), to enable it to slide along the shaft 122.

Optionally, the motor 120 drives one of the pulley systems 118*b*, which causes the drawbar 116*b* and its corresponding collet 112*b* to rotate, and also causes the shaft 122 to rotate. Rotation of the shaft 122 causes the other pulley system 118*a* to move, which causes the other drawbar 116*a* and its corresponding collet 112*a* to rotate.

In an embodiment, the rotation mechanism 56 enables rotation speeds up to approximately 3000 rpm. In another embodiment, the rotation mechanism 56 enables rotation speeds in a range between approximately 3000 rpm and approximately 4000 rpm. In a further embodiment, the rotation mechanism 56 enables rotation speeds in a range between approximately 4000 rpm and approximately 5000 rpm. In another embodiment, the rotation mechanism 56 enables rotation speeds up to approximately 6000 rpm.

Rotation of the collets 112*a*, 112*b* causes the feedstock 20 to rotate during grinding. The shaft 122 maintains the rotation synchronicity of both collets 112*a*, 112*b*, thus preventing the feedstock 20 from twisting. The motor 120 is controlled by an axis of the controller 104.

The pulley systems 118*a*, 118*b*, as shown are standard belt-driven systems, and their detailed implementation is within the realm of one of ordinary skill in the art. Therefore, a detailed description thereof has been omitted.

It should be understood that the present invention is not limited to the rotation scheme described above, and the scope of the present invention encompasses other schemes for rotating the feedstock 20.

During operation, the controller 104 runs a program that controls the motor system 102, provides commands to open and close the collets 112*a*, 112*b*, controls the motor 120 driving the rotation system, and controls a grinding position of the grinding mechanism 200. The motor system 102 moves the carriage assemblies 106*a*, 106*b* back and forth on the track 140. At any time during grinding of the feedstock 20, at least one of the collets 112*a*, 112*b* is in the closed position and moves the feedstock 20 in a forward direction at a feed rate and a longitudinal position set by the controller 104. When the first carriage assembly 106*a* reaches the end of its travel span, a signal is sent from the controller 104 to open the first collet 112*a*, thus causing it to release its hold on the feedstock 20. The motor system 102, under control of the controller 104, then causes the first carriage assembly 106*a* to move backward along the track 140 for a set distance, thus causing the first collet assembly 110*a*, including the first drawbar 116*a* and the first collet 112*a*, to move backward by that distance. The controller 104 then sends a signal to close the first collet 112*a*, thus causing it to grasp the feedstock 20 at a new position upstream from where the first collet 112*a* released the feedstock 20. The controller 104 then controls the motor system 102 to move the first carriage assembly 106*a* forward along the track 140 at the same rate of forward motion as that of the second carriage 106*b* assembly.

At the same time that the first carriage assembly 106*a* changes direction to grasp an upstream section of the feedstock 20, the second carriage assembly 106*b* has not yet reached the end of its travel span. Therefore, the second collet 112*b* maintains its hold on the feedstock 20, thus maintaining the rotation of the feedstock 20 and the forward motion of the feedstock 20 at the set feed rate, thus controlling the longitudinal position of the feedstock 20 and avoiding any lapses in position control.

Similarly, when the second carriage assembly 106*b* reaches the end of its travel span, a signal is sent from the controller 104 to open the second collet 112*b*, thus causing it to release its hold on the feedstock 20. The motor system 102, under control of the controller 104, then causes the second carriage assembly 106*b* to move backward along the track 140 for a set distance, without interfering with the first carriage assembly continuously at the set feed rate by at least one of the collets 106*a*, thus causing the second collet assembly 110*b*, along with the second drawbar 116*b* and the second collet 112*b*, to move backward by that distance. The controller 104 then sends a signal to close the second collet 112*b*, thus causing the second collet 112*b* to grasp the feedstock 20 at a new position upstream from where the second collet 112*b* released the feedstock 20. The controller 104 then controls the motor system 102 to move the second carriage assembly 106*b* forward along the track 140 at the same rate of forward motion as that of the first carriage assembly 106*a*.

At the same time that the second carriage assembly 106*b* changes direction to grasp an upstream section of the feedstock 20, the first carriage assembly 106*a* has not yet reached the end of its travel span. Therefore, the first collet 112*a* maintains its hold on the feedstock 20, thus maintaining the rotation of the feedstock 20 and the forward motion of the feedstock 20 at the set feed rate, thus controlling the longitudinal position of the feedstock 20 and avoiding stops in forward movement of the feedstock 20, and also avoiding any lapses in position control.

By setting the carriage assemblies 106*a*, 106*b* such that at least one of them is moving forward along the track 140 during grinding of the feedstock 20, the longitudinal position of the feedstock 20 is controlled and the feedstock 20 moves forward. The collets 112*a*, 112*b*, alternately release hold of the feedstock 20 and move backward along the track 140 to grasp an upstream section of the feedstock 20 to thus advance the feedstock 20 without any discontinuity in its rotational and forward motion. This continuous movement allows an arbitrarily long length of feedstock 20 to be ground.

In an embodiment, if it is not necessary to have continuous (non-stop) movement of the feedstock 20 over a long length of the feedstock 20, it is possible to use only a single carriage assembly 106*a* or 106*b* and only a single collet assembly 110*a* or 110*b*. In this embodiment, the feedstock 20 would be ground over a finite length corresponding to a movement span of one carriage assembly 106*a* or 106*b* in coordination with one collet assembly 110*a* or 110*b*. When grinding of that finite length is completed, movement of the feedstock 20 stops, and the one carriage assembly 106*a* or 106*b* in coordination with one collet assembly 110*a* or 110*b* releases grip of the feedstock 20 and moves in a direction to grip a new section of the feedstock 20 and bring that new section into a grinding region to be ground by the grinding mechanism 200.

Optionally, the spool-fed wire grinding system 10 may include a wire cutter 40 positioned downstream of the grinding mechanism 200 and controlled by the computer controller 16. The wire cutter 40 may be used advantageously to continuously produce ground articles of a predetermined length. For example, the spool-fed grinding system 10 with the wire cutter 40 may be controlled by the computer controller 16 to produce 100 or 1000 or any desired number of articles that have been ground to have a desired profile and that have been cut to a desired length. In this way, mass production of ground articles is facilitated by the spool-fed grinding system 10.

The spool-fed wire grinding system 10 may further include a gauging system 32 for obtaining real-time profile measurements of the wire 20 during grinding, as schematically shown in FIG. 1A. In an embodiment, the gauging system 32 may be an optical scanner that measures the diameter of the wire 20 using a high-speed laser scanner (not shown) that performs real-time diameter and length (or position) readings at a rate of up to approximately 2400 readings per second at a resolution as low as 0.01 μm. For example, the gauging system 32 may be the P4K Guidewire Gauging System (Glebar Company, Inc., Franklin Lakes, N.J.).

As with other parts of the spool-fed wire grinding system 10, the gauging system 32 is controlled by the computer controller 16 and outputs measurement data to the memory 34 of the computer controller 16. A display screen 36 and an input device 38, such as a keyboard or touch-sensitive tablet, are operatively connected to the computer controller 16, either through one or more cable connections or wirelessly via wifi or another known wireless communication method.

In an embodiment, the computer controller 16 controls the grinding machine 1000 in accordance with measurements taken by the gauging system 32. That is, the computer controller 16 utilizes length data and diameter data, which are obtained from real-time measurements of the feedstock 20 as it is being ground, and calculates adjustments to a grinding position of the grinding mechanism 200 and/or adjustments to a linear feed rate of the feedstock 20 transported by the linear movement mechanism 100 to ensure that a desired profile is produced on the ground feedstock 20.

The display screen 36 may be used by an operator to, for example, monitor a grinding process in progress. In association with the gauging system 32, the display screen 36 may be used for real-time visual inspection of the profile measurements of the wire 20 during grinding. Optionally, a video camera (not shown) may be used for magnified visual inspection of various features of the grinding machine 1000, with still images or moving video from the video camera being displayed on the display screen 36.

The input device may be used by an operator to input parameters to control various parts of the the spool-fed grinding system 10 via the computer controller 16.

Dual-Spool Grinding System

Figure 3A:
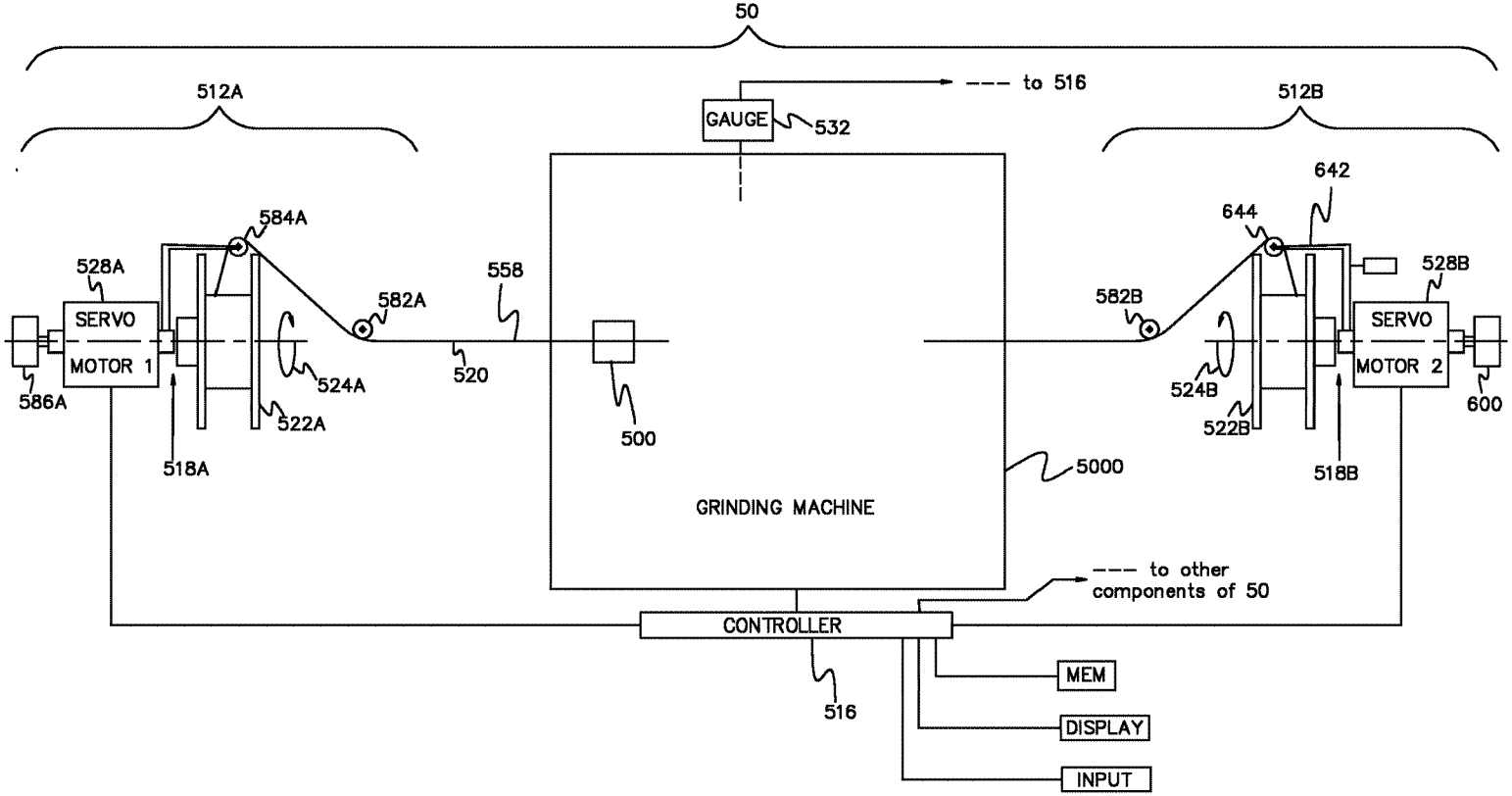
FIGS. 3A and 3B schematically show a dual-spooling grinding system according to an embodiment of the present invention.
Figure 3B:
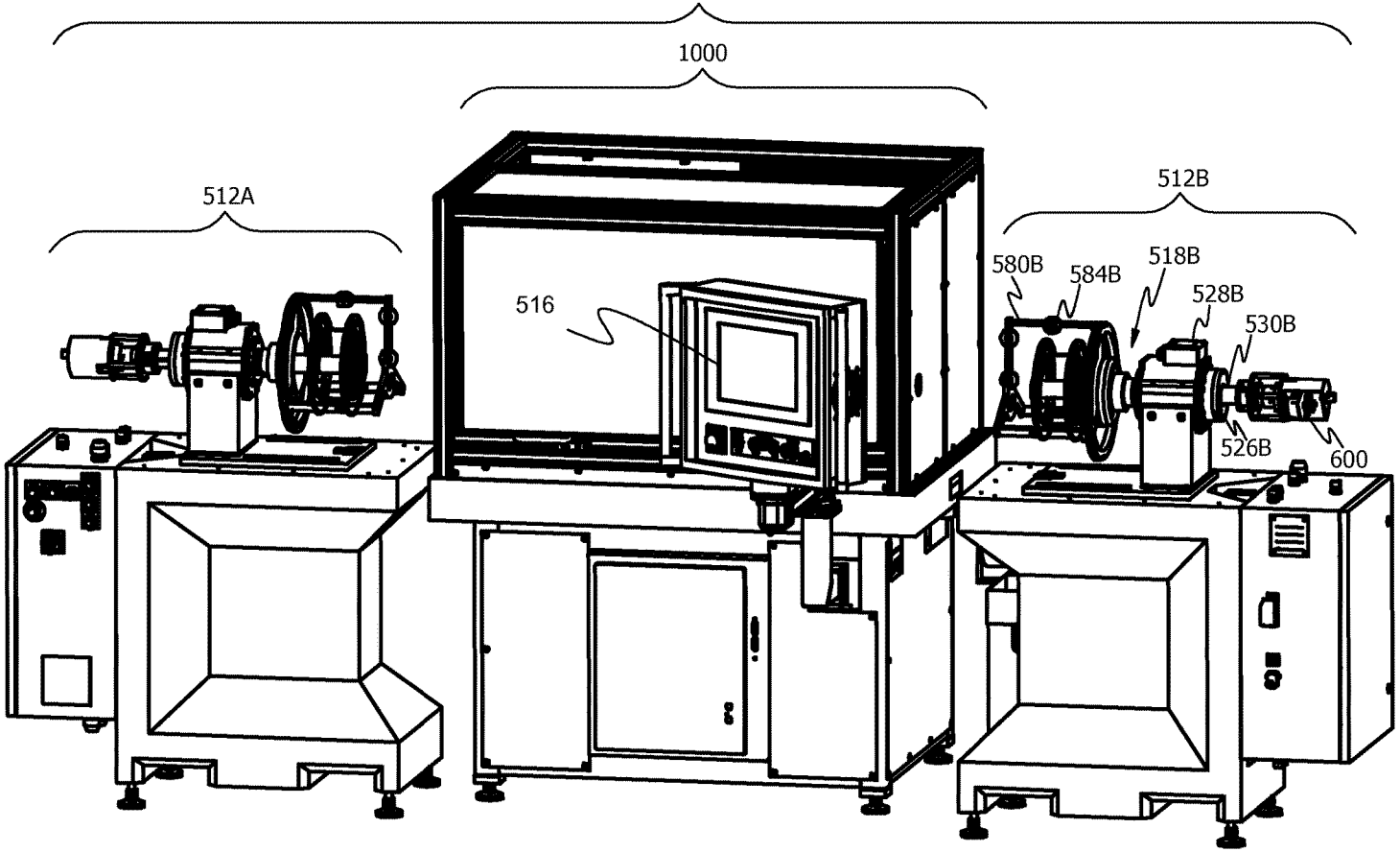

FIGS. 3A and 3B schematically show a dual-spool wire grinding system 50 for grinding wire. The dual-spool system 50 includes a first spooling mechanism 512A, a second spooling mechanism 512B, a grinding machine 5000, and a computer controller 516 that controls the first and second spooling mechanisms 512A, 512B and the grinding machine 5000. The first spooling mechanism 512A includes a first spool assembly 518A from which wire 520 is unwound from a first spool 522A mounted thereon. The first spool assembly 518A has a first axis of rotation 524A on which the first spool 522A spins to unwind the wire 520 before grinding. The second spooling mechanism 512B includes a second spool assembly 518B to which the wire 520 is wound after grinding. The second spool assembly 518B has a second axis of rotation 524B on which a second spool 522B spins to wind the wire 520.

The grinding machine 5000, which is positioned between the first spooling mechanism 512A and the second spooling mechanism 512B, is analogous to the grinding machine 1000 discussed above, and therefore a description of the grinding machine 5000 has been omitted herein to avoid repetition. Similarly, the first spooling mechanism 512A is analogous to the spooling mechanism 12 discussed above, and therefore a description of the first spooling mechanism 512A has been omitted herein to avoid repetition. As will be appreciated by the reader, features relating to the grinding machine 5000 corresponding to features relating to the grinding machine 1000 may be shown and/or described to have the same reference numeral with a leading "5" (e.g., 1000 and 5000). Likewise, features of the first spooling mechanism 512A corresponding to features of the spooling mechanism 12 may be shown and/or described to have the same reference numeral with a leading "5" (e.g., 12 and 512).

The computer controller 516 controls the first and second spooling mechanisms 512A, 512B to rotate the first and second spools 522A, 522B at approximately the same rotation speed as a rotation speed of the wire 520 during grinding, such that there is no twisting of the wire 520 during grinding.

The dual-spool system 50 is similar to the spool-fed grinding system 10, but with the addition of the second spooling mechanism 512B positioned on the downstream side of the grinding machine 5000.

In the dual-spool system 50, the first axis of rotation 524A of the first spool 522A, the second axis of rotation 524B of the second spool 522B, and the longitudinal grinding axis 558 generally are not transverse with each other. As will be appreciated by the reader, although not explicitly shown, the longitudinal grinding axis 558 coincides with an axial direction of a straight portion of the wire 520 that is being ground.

In an embodiment, the first axis of rotation 524A of the first spool 522A, the second axis of rotation 524B of the second spool 522B, and the longitudinal grinding axis 558 generally are oriented to coincide with each other as a common axis. In another embodiment, the first axis of rotation 524A of the first spool 522A, the second axis of rotation 524B of the second spool 522B, and the longitudinal grinding axis 558 generally are oriented to be approximately parallel axes.

The second spool assembly 518B includes a tensioner device 600 for maintaining tension on the wire 520 during grinding and winding on the second spool 522B. In an embodiment, the tensioner device 600 is controlled by the computer controller 516 and may be an electrical or electromechanical clutch device that is programmable to control a rotational resistance of the second spool 522B to wind portions of the wire 520 that have been ground, as well as to prevent unwinding or slippage of the second spool 522B during grinding of the wire 520. In another embodiment, the tensioner device 600 may be a friction-based brake device, such as felt or another textured, friction-generating material.

Figure 3C:
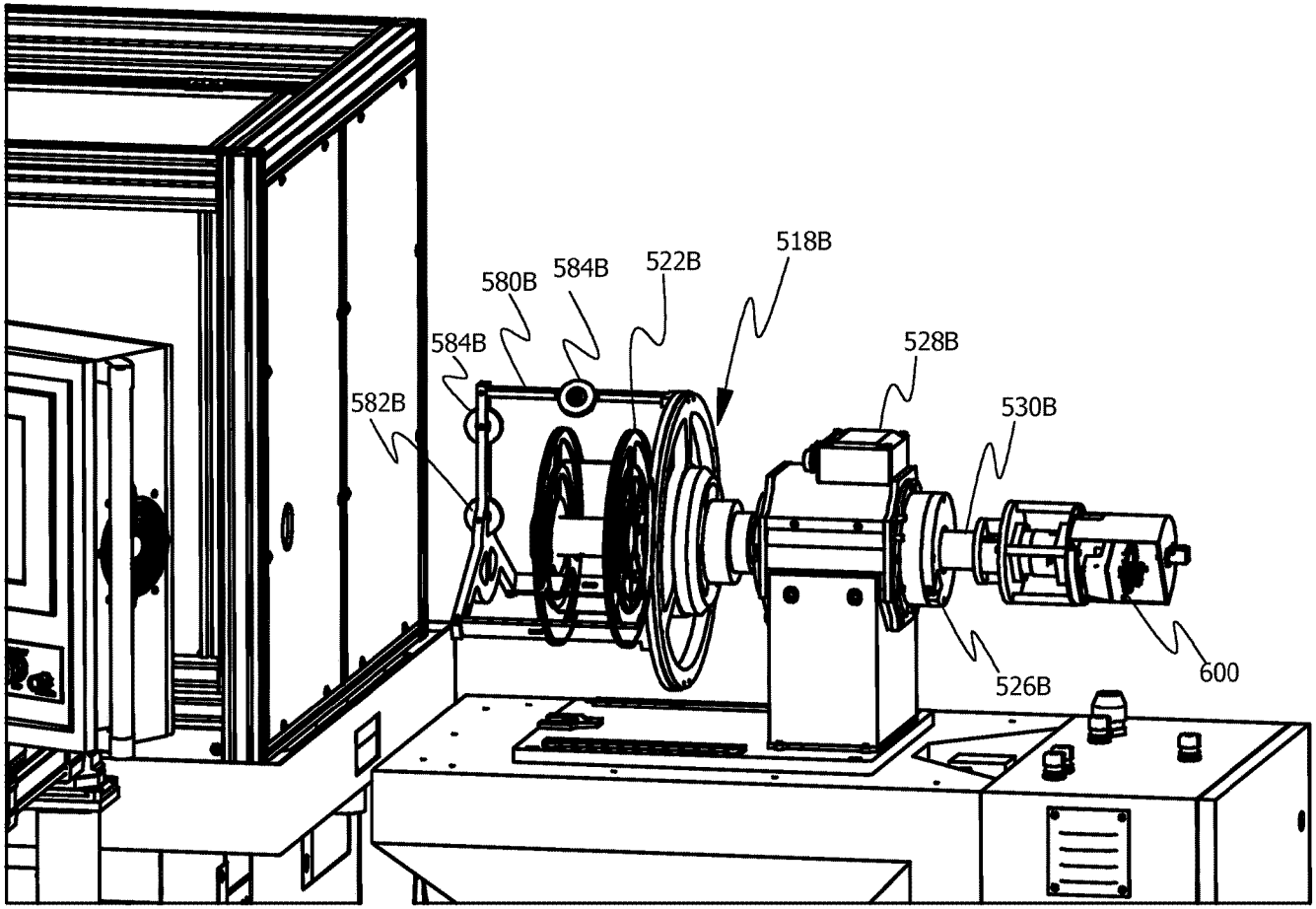
FIG. 3C schematically shows an unptake-side spooling mechanism according to an embodiment of the present invention, for uptaking ground wire.

The second spooling mechanism 512B includes a second frame assembly 580B for positioning an uptake guide device 582B relative to the second spool 522B, as shown in FIG. 3C. The uptake guide device 582B is arranged to orient processed wire 520, which already has been ground and which extends downstream from the linear movement mechanism 500, such that a portion of the processed wire 520 extending between the linear movement mechanism 500 and the uptake guide device 582B is approximately at a predetermined position relative to the longitudinal grinding axis 558. For example, the uptake guide device 582B may be a pulley that is positioned to align the wire 520 from the linear movement mechanism 500 to a predetermined position relative to the second spool 522B. The predetermined position may be a position that aligns the portion of the wire 520 between the pulley (i.e., uptake guide device) 582B and the linear movement mechanism 500 to:

- an angle within 35° of the longitudinal grinding axis 558, or
- an angle within 25° of the longitudinal grinding axis 558, or
- an angle within 15° of the longitudinal grinding axis 558, or
- an angle within 10° of the longitudinal grinding axis 558, or
- approximately coincide with the longitudinal grinding axis 558.

The pulley (i.e., uptake guide device) 582B may be one of a plurality of pulleys 584B arranged to guide the wire 520, which has been ground by the grinding machine 5000, toward the second spool 522B of the second spooling mechanism 512B.

In an embodiment, the second spooling mechanism 512B includes a motorized wire guide assembly 642, which is controlled by the computer controller 516 to move the wire 520 back and forth along the second spool 522B to produce uniform layers of the wire 520 wrapped on the second spool 522B. For example, the motorized wire guide assembly 642 moves a spooling guide 644, such as a pulley, back and forth in a direction parallel to or coinciding with the longitudinal grinding axis 558 to wind the wire 520 on the second spool 522B after grinding, such that the wire 520 is wound on the second spool 522B in uniform layers. The motorized wire guide assembly 642 is controlled by the computer controller 516 such that back and forth movement of the spooling guide 644 is controlled based on a diameter of the wire 520 and a linear advancement rate of the wire 520 toward the second spool assembly 518B.

Alternatively, the uptake guide device 582B need not include any pulley but instead may be support member (not shown) that is arranged to align the wire 520 ground by the grinding machine 5000 to a predetermined height relative to the longitudinal grinding axis 558. The support member can be a horizontal or flat bar, a V-shaped bar, a U-shaped bar, or the like.

In an embodiment, the second spooling mechanism 512B includes a second bearing or belt assembly 526B coupled to the second spool assembly 518B, and a second motor 528B coupled to the second bearing or belt assembly 526B. In FIGS. 3B and 3C the second bearing or belt assembly 526B and the second motor 528B are shown to be housed together in their coupled state. In another embodiment, the second motor 528B is directly coupled to the second spool assembly 518B (see FIG. 3A). The second motor 528B is controlled by the computer controller 516 to rotate the second spool assembly 518B at approximately the same rotation speed as the rotation speed of the wire 520 during grinding.

In an embodiment, the second spool assembly 518B is coupled to the second motor 528B, either directly or through the second bearing or belt assembly 526B, via a second shaft assembly 530B having a distal end that is structured to have the second spool 522B mounted thereon during grinding. The second shaft assembly 530B is rotated by the second motor 528B during grinding, such that the second spool 522B is rotated about an axis that is approximately parallel to or that coincides with the longitudinal grinding axis 558. The rotation speed of the second spool 522B is approximately the same as the rotation speed of the wire 520 during grinding. The second shaft assembly 530B may include a single shaft or a plurality of coordinated shafts.

In an embodiment, the second frame assembly 580B is coupled to the second shaft assembly 530B, such that the second frame assembly 580B rotates at approximately the same rotation speed as the rotation speed of the wire 520 during grinding.

The computer controller 16, 516 may be formed of any computer or computers coupled to a tangible computer-readable storage medium known in the art and programmed to control the grinding system 10, 50.

As will be readily appreciated by the reader, the dual-spool grinding system 50 may include other features of the spool-fed wire grinding system 10 described above (e.g., the video camera, the gauging system 32, the feedback control of the grinding machine 1000 based on data obtained from the gauging system 32). A description of these other features for the dual-spool grinding system 50 is omitted herein to avoid repetition.

Finally, the above descriptions are directed to various embodiments of the present invention, and other embodiments not specifically described are within the scope of the present invention.

What is claimed is:

1. A spool-fed grinding system comprising:

a spooling mechanism for mounting a spool assembly that includes a spool from which wire is unwound, the spool assembly having an axis of rotation on which the spool spins while the wire is being ground;

a grinding machine that includes:

a grinding wheel for grinding a profile along an outer surface of the wire, a linear movement mechanism for unwinding the wire from the spool and for holding and linearly moving the wire during grinding, the linear movement mechanism controlling movement of the wire along a longitudinal grinding axis, and a rotation mechanism for rotating the wire about the longitudinal grinding axis during grinding at a rotation speed in a range between approximately 3000 rpm and approximately 6000 rpm; and a computer controller programmed to control coordinated operation of the spooling mechanism and the grinding machine, wherein the axis of rotation of the spool assembly and the longitudinal grinding axis are not transverse with each other, wherein the spooling mechanism includes a guide device arranged to orient the wire unwound from the spool relative to the linear movement mechanism, wherein the spooling mechanism is controlled to rotate the spool and the guide device at approximately a same rotation speed as a rotation speed of the wire during grinding to avoid twisting of the wire while the wire is being ground.

2. The spool-fed grinding system according to claim 1, wherein the axis of rotation of the spool assembly and the longitudinal grinding axis are oriented to coincide with each other as a common axis.

3. The spool-fed grinding system according to claim 1, wherein the axis of rotation of the spool assembly and the longitudinal grinding axis are oriented to be approximately parallel axes.

4. The spool-fed grinding system according to claim 1, wherein the unwinding of the wire from the spool by the linear movement system does not require the spool to be electrically powered.

5. The spool-fed grinding system according to claim 1, wherein the linear movement mechanism, which holds the wire during grinding, unwinds the wire from the spool by pulling the wire from the spool.

6. The spool-fed grinding system according to claim 1, wherein the spool assembly includes a brake device for maintaining tension on the wire during grinding and unwinding.

7. The spool-fed wire grinding system according to claim 1, wherein the spooling mechanism includes a frame assembly for positioning the guide device relative to the spool, the guide device being arranged to orient the wire unwound from the spool such that a portion of the wire between the guide device and the linear movement mechanism is approximately at a predetermined position relative to the longitudinal grinding axis, and wherein the spooling mechanism rotates the frame assembly together with the spool.

8. The spool-fed wire grinding system according to claim 7, wherein the guide device is a pulley system that includes at least one pulley.

9. The spool-fed wire grinding system according to claim 7, wherein the guide device is one of:

a horizontal support member, a V-shaped support member, and a U-shaped support member.

10. The spool-fed wire grinding system according to claim 7, wherein the portion of the wire between the guide device and the linear movement mechanism is oriented approximately at an angle that is within 25° of the longitudinal grinding axis.

11. The spool-fed wire grinding system according to claim 7, wherein the portion of the wire between the guide device and the linear movement mechanism is oriented approximately at an angle that is within 15° of the longitudinal grinding axis.

12. The spool-fed wire grinding system according to claim 7, wherein the portion of the wire between the guide device and the linear movement mechanism is oriented approximately at an angle that is within 10° of the longitudinal grinding axis.

13. The spool-fed wire grinding system according to claim 7, wherein the portion of the wire between the guide device and the linear movement mechanism is oriented approximately to align with the longitudinal grinding axis.

14. The spool-fed wire grinding system according to claim 7, wherein the spooling mechanism includes a motor coupled to the spool assembly, and wherein the motor is controlled by the computer controller to rotate the spool assembly at approximately a same rotation speed as the rotation speed of the wire during grinding.

15. The spool-fed wire grinding system according to claim 14, wherein the motor is coupled to a shaft assembly having a distal end that is structured to have the spool mounted thereon during grinding, the shaft assembly being rotated by the motor during grinding.

16. The spool-fed wire grinding system according to claim 14, wherein the frame assembly is coupled to the motor such that the frame assembly rotates at approximately a same rotation speed as the rotation speed of the wire during grinding.

17. The spool-fed wire grinding system according to claim 1, wherein the linear movement mechanism includes a motor and a single collet assembly that are controlled by the computer controller to control linear or longitudinal positioning of the wire and to feed the wire to the grinding machine by selectively gripping and releasing the wire during grinding, such that the wire is unwound from the spool as needed through pulling action by the collet assembly.

18. The spool-fed wire grinding system according to claim 17, wherein the collet assembly includes a collet motor and a collet, and wherein the collet is in a gripping relationship with the wire during linear movement of the wire or during rotation of the wire.

19. The spool-fed wire grinding system according to claim 1, further comprising a gauging system for obtaining real-time profile measurements of the wire during grinding.

20. The spool-fed wire grinding system according to claim 19, wherein the gauging system includes an optical scanner.

21. The spool-fed wire grinding system according to claim 20, wherein the optical scanner is a high-speed laser scanner that performs real-time diameter readings at a rate of up to approximately 2400 readings per second at a resolution as low as 0.01 μm.

22. The spool-fed wire grinding system according to claim 21, wherein the gauging system is controlled by the computer controller and outputs measurement data to a memory of the computer controller.

23. The spool-fed wire grinding system according to claim 21, wherein the computer controller includes a display screen for real-time visual inspection of the profile measurements of the wire during grinding.

24. The spool-fed wire grinding system according to claim 19, wherein the computer controller includes a video camera and a display screen for enabling an operator to inspect parts of the grinding machine in real-time during grinding.

25. The spool-fed wire grinding system according to claim 19, wherein data from the gauging system is used by the computer controller to perform real-time grinding adjustments by automatically controlling one or both of:

a grinding position of the grinding wheel, and a linear or longitudinal position of the wire during grinding, via control of the linear movement mechanism.

26. The spool-fed wire grinding system according to claim 1, further comprising a wire cutter positioned on a downstream side of the grinding machine for cutting a portion of the wire after the portion of the wire has been ground, wherein the cutter is electronically controlled by the computer controller.

27. The spool-fed wire grinding system according to claim 1, wherein the linear movement mechanism controls the wire to move continuously along the longitudinal grinding axis.

28. The spool-fed wire grinding system according to claim 1, wherein the linear movement mechanism controls the wire to move discontinuously in a stop-and-start manner along the longitudinal grinding axis.

29. The spool-fed wire grinding system according to claim 1, wherein the linear movement mechanism includes a plurality of collet assemblies and a motor that are controlled by the computer controller to control linear or longitudinal positioning of the wire and to continuously feed the wire to the grinding machine by selectively gripping and releasing the wire during grinding, such that the wire is unwound from the spool as needed through pulling action by the collet assembly.

30. The spool-fed wire grinding system according to claim 29, wherein each of the plurality of collet assemblies includes a collet, and wherein at least one collet is in a gripping relationship with the wire during continuous linear movement of the wire or during rotation of the wire.

31. A dual-spool wire grinding system for continuously grinding wire, the system comprising:

a first spooling mechanism for mounting a first spool assembly that includes a first spool from which wire is unwound, the first spool assembly having a first axis of rotation on which the first spool spins while the wire is being ground;

a second spooling mechanism for mounting a second spool assembly to which the wire is wound after grinding, the second spool assembly having a second axis of rotation on which a second spool spins while the wire is being ground;

a grinding machine positioned between the first spooling mechanism and the second spooling mechanism, the grinding machine including:

a grinding wheel for grinding a profile along an outer surface of the wire, a linear movement mechanism for unwinding the wire from the first spool and for holding and linearly moving the wire during grinding, the linear movement mechanism controlling longitudinal movement of the wire along a longitudinal grinding axis between the first spooling mechanism and the second spooling mechanism, and a rotation mechanism for rotating the wire about the longitudinal grinding axis during grinding at a rotation speed in a range between approximately 3000 rpm and approximately 6000 rpm; and a computer controller programmed to control coordinated operation of the first and second spooling mechanisms and the grinding machine, wherein the first axis of rotation of the first spool assembly, the second axis of rotation of the second spool assembly, and the longitudinal grinding axis are not transverse with each other, wherein the first spooling mechanism includes a guide device arranged to orient the wire unwound from the first spool relative to the linear movement mechanism, and wherein the first spooling mechanism and the second spooling mechanism are controlled to rotate the guide device, the first spool, and the second spool at approximately a same rotation speed as a rotation speed of the wire during grinding to avoid twisting of the wire while the wire is being ground.

32. The dual-spool wire grinding system according to claim 31, wherein the first axis of rotation of the first spool assembly, the second axis of rotation of the second spool assembly, and the longitudinal grinding axis are oriented to coincide with each other as a common axis.

33. The dual-spool wire grinding system according to claim 31, wherein the first axis of rotation of the first spool assembly, the second axis of rotation of the second spool assembly, and the longitudinal grinding axis are oriented to be approximately parallel axes.

34. The dual-spool wire grinding system according to claim 31, wherein the unwinding of the wire from the first spool does not require the first spool to be electrically powered.

35. The dual-spool wire grinding system according to claim 31, wherein the wire is unwound from the first spool when the linear movement system, which holds the wire and controls continuous longitudinal movement of the wire during grinding, pulls the wire toward the second spool during grinding.

36. The dual-spool wire grinding system according to claim 31, wherein the first spool assembly includes a braking device for maintaining tension on the wire during grinding and unwinding.

37. The dual-spool wire grinding system according to claim 36, wherein the computer controller controls the braking device such that activation and deactivation of the braking device is coordinated with operation of the linear movement mechanism.

38. The dual-spool wire grinding system according to claim 31, wherein the first spooling mechanism includes a first frame assembly for supporting the guide device relative to the first spool, the guide device being arranged to orient the wire unwound from the first spool such that the wire is guided in a direction generally toward the linear movement mechanism, and wherein the first spooling mechanism rotates the first frame assembly together with the first spool.

39. The dual-spool wire grinding system according to claim 38, wherein the guide device is structured to orient the wire unwound from the first spool such that a portion of the wire extending between the guide device and the linear movement mechanism is approximately at a predetermined position relative to the longitudinal grinding axis.

40. The dual-spool wire grinding system according to claim 38, wherein the guide device is a pulley system that includes at least one pulley.

41. The dual-spool wire grinding system according to claim 38, wherein the guide device is one of:

a horizontal support member, a V-shaped support member, and a U-shaped support member.

42. The dual-spool wire grinding system according to claim 38, wherein the portion of the wire between the guide device and the linear movement mechanism is oriented approximately at an angle that is within 25° of the longitudinal grinding axis.

43. The dual-spool wire grinding system according to claim 38, wherein the portion of the wire between the guide device and the linear movement mechanism is oriented approximately at an angle that is within 15° of the longitudinal grinding axis.

44. The dual-spool wire grinding system according to claim 38, wherein the portion of the wire between the guide device and the linear movement mechanism is oriented approximately at an angle that is within 10° of the longitudinal grinding axis.

45. The dual-spool wire grinding system according to claim 38, wherein the portion of the wire between the guide device and the linear movement mechanism is oriented approximately to align with the longitudinal grinding axis.

46. The dual-spool wire grinding system according to claim 31, wherein the first spooling mechanism includes a first motor coupled to the first spool assembly, and wherein the first motor is controlled by the computer controller to rotate the first spool assembly at approximately a same rotation speed as the rotation speed of the wire during grinding.

47. The dual-spool wire grinding system according to claim 46, wherein the first motor is coupled to a first shaft assembly having a distal end that is structured to have the first spool mounted thereon during grinding, the first shaft assembly being rotated by the first motor during grinding.

48. The dual-spool wire grinding system according to claim 46, wherein the first frame assembly is coupled to the first motor such that the first frame assembly rotates at approximately a same rotation speed as the rotation speed of the wire during grinding.

49. The dual-spool wire grinding system according to claim 31, wherein the second spool assembly includes a programmable tensioner device for maintaining tension on the wire during grinding and winding on the second spool, the programmable tensioner device being controlled by the computer controller.

50. The dual-spool wire grinding system according to claim 31, wherein the second spooling mechanism includes a second frame assembly for positioning an uptake guide device relative to the second spool, the uptake guide device being arranged to orient processed wire ground by the grinding wheel and extending downstream from the linear movement mechanism such that a portion of the processed wire extending between the linear movement mechanism and the uptake guide device is approximately at a predetermined position relative to the longitudinal grinding axis.

51. The dual-spool wire grinding system according to claim 50, wherein the uptake guide device is a pulley system that includes at least one pulley.

52. The dual-spool wire grinding system according to claim 50, wherein the uptake guide device is one of:

a horizontal support member, a V-shaped support member, and a U-shaped support member.

53. The dual-spool wire grinding system according to claim 50, wherein the portion of the wire between the uptake guide device and the linear movement mechanism is oriented approximately at an angle that is within 25° of the longitudinal grinding axis.

54. The dual-spool wire grinding system according to claim 50, wherein the portion of the wire between the uptake guide device and the linear movement mechanism is oriented approximately at an angle that is within 15° of the longitudinal grinding axis.

55. The dual-spool wire grinding system according to claim 50, wherein the portion of the wire between the uptake guide device and the linear movement mechanism is oriented approximately at an angle that is within 10° of the longitudinal grinding axis.

56. The dual-spool wire grinding system according to claim 50, wherein the portion of the wire between the uptake guide device and the linear movement mechanism is oriented to approximately align with the longitudinal grinding axis.

57. The dual-spool wire grinding system according to claim 50, wherein the second frame assembly is coupled to the second motor such that the second frame assembly rotates at approximately a same rotation speed as the rotation speed of the wire during grinding.

58. The dual-spool wire grinding system according to claim 31, wherein the second spooling mechanism includes a second motor coupled to the second spool assembly, and wherein the second motor is controlled by the computer controller to rotate the second spool assembly at approximately a same rotation speed as the rotation speed of the wire during grinding.

59. The dual-spool wire grinding system according to claim 58, wherein the second motor is coupled to a second shaft assembly having a distal end that is structured to have the second spool mounted thereon during grinding, the second shaft assembly being rotated by the second motor during grinding.

60. The dual-spool wire grinding system according to claim 31, wherein the second spooling mechanism includes a motorized wire guide assembly that moves an uptake guide back and forth in a direction parallel to or coinciding with the longitudinal grinding axis to wind the wire on the second spool after grinding, such that the wire is wound on the second spool in uniform layers, and wherein the motorized wire guide assembly is controlled by the computer controller such that back and forth movement of the uptake guide is controlled based on a diameter of the wire and a linear advancement rate of the wire toward the second spool assembly.

61. The dual-spool wire grinding system according to claim 31, wherein the linear movement mechanism includes a motor and a single collet assembly that are controlled by the computer controller to control linear or longitudinal positioning of the wire and to feed the wire to the grinding machine by selectively gripping and releasing the wire during grinding, such that the wire is unwound from the first spool as needed through pulling action by the collet assembly.

62. The dual-spool wire grinding system according to claim 61, wherein the collet assembly includes a collet motor and a collet, and wherein the collet is in a gripping relationship with the wire during linear movement of the wire or during rotation of the wire.

63. The dual-spool wire grinding system according to claim 31, further comprising a gauging system for obtaining real-time profile measurements of the wire during grinding.

64. The dual-spool wire grinding system according to claim 63, wherein the gauging system includes an optical scanner.

65. The dual-spool wire grinding system according to claim 64, wherein the optical scanner is a high-speed laser scanner that performs real-time diameter readings at a rate of up to approximately 2400 readings per second at a resolution as low as 0.01 μm.

66. The dual-spool wire grinding system according to claim 63, wherein the gauging system is controlled by the computer controller and outputs measurement data to a memory of the computer controller.

67. The dual-spool wire grinding system according to claim 63, wherein the computer controller includes a display screen for real-time visual inspection of the profile measurements of the wire during grinding.

68. The dual-spool wire grinding system according to claim 63, wherein data from the gauging system is used by the computer controller to perform real-time grinding adjustments by automatically controlling one or both of:

a grinding position of the grinding wheel, and a linear or longitudinal position of the wire during grinding, via control of the linear movement mechanism.

69. The dual-spool wire grinding system according to claim 31, wherein the computer controller includes a video camera and a display screen for enabling an operator to inspect parts of the grinding machine in real-time during grinding.

70. The dual-spool wire grinding system according to claim 31, wherein the linear movement mechanism controls the wire to move continuously along the longitudinal grinding axis.

71. The dual-spool wire grinding system according to claim 31, wherein the linear movement mechanism controls the wire to move discontinuously in a stop-and-start manner along the longitudinal grinding axis.

72. The dual-spool wire grinding system according to claim 31, wherein the linear movement mechanism includes a plurality of collet assemblies and a motor that are controlled by the computer controller to control linear or longitudinal positioning of the wire and to continuously feed the wire to the grinding machine by selectively gripping and releasing the wire during grinding, such that the wire is unwound from the spool as needed through pulling action by the collet assembly.

73. The dual-spool wire grinding system according to claim 72, wherein each of the plurality of collet assemblies includes a collet, and wherein at least one collet is in a gripping relationship with the wire during continuous linear movement of the wire or during rotation of the wire.

* * * * *